US005353857A

United States Patent [19]

Anderson

[11] Patent Number: 5,353,857

[45] Date of Patent: Oct. 11, 1994

[54] BRACKET AND HEADRAIL COMBINATION FOR A BLIND

[75] Inventor: Richard N. Anderson, Whitesville, Ky.

[73] Assignee: Hunter Douglas, Inc., Upper Saddle River, N.J.

[21] Appl. No.: 139,976

[22] Filed: Oct. 20, 1993

Related U.S. Application Data

[63] Continuation of Ser. No. 854,341, Mar. 18, 1992, abandoned.

[51] Int. Cl.[5] ..... E06B 9/30

[52] U.S. Cl. ..... 160/178.1; 160/902; 248/251

[58] Field of Search ..... 160/178.1, 176.1, 168.1, 160/902; 248/221.3, 221.4, 251, 252, 254, 262, 264

[56] References Cited

U.S. PATENT DOCUMENTS

| | | | |
|---|---|---|---|
| 4,235,406 | 11/1980 | Vecchiarelli | 248/251 |
| 4,475,706 | 10/1984 | Anderson | 248/251 X |
| 4,802,644 | 2/1989 | Oskam | 248/254 X |
| 4,886,102 | 12/1989 | Debs | 160/178.1 X |
| 5,042,553 | 8/1991 | Schaffer et al. | 160/178.1 |
| 5,060,710 | 10/1991 | Haarer | 248/262 X |
| 5,074,350 | 12/1991 | Carter | 160/178.1 |

*Primary Examiner*—David M. Purol

[57] ABSTRACT

This invention relates to a bracket and headrail combination for supporting a venetian blind in a window opening. The bracket of the combination can be mounted to a vertical or horizontal surface adjacent to the window opening, and is substantially hidden from view when the headrail is installed. The bracket configuration inhibits longitudinal sliding of the headrail, and accommodates misalignment between brackets while still allowing for successful headrail installation.

14 Claims, 6 Drawing Sheets

BRACKET AND HEADRAIL COMBINATION FOR A BLIND

CROSS REFERENCE TO RELATED APPLICATION

This application is a continuation of copending, commonly-assigned U.S. patent application Ser. No. 07/854,341, now abandoned.

BACKGROUND OF INVENTION

Venetian blinds are typically mounted to the face of a window, or to a header adjacent to a window, by bracket and headrail combinations. Many types of bracket and headrail combinations have been developed for mounting venetian blinds in window openings.

Early brackets were generally cup-shaped and intended to slide over the ends of the headrail. These brackets had several drawbacks. The first related to their unsightly appearance. Since the brackets slid over the ends of the headrail, there was an interruption of the smooth appearance of the headrail. In addition, since the brackets were visible, the brackets had to coordinate with the color of the headrail, necessitating manufacturing and inventorying of brackets of many colors. Often, the sides of the brackets were also visible, revealing unsightly screws used to mount the headrail to the brackets.

Later brackets have overcome these drawbacks. Later brackets are generally mounted inwardly from the ends of the headrail and as a result are less visible than cup-shaped brackets. These brackets, however, have their own drawbacks. Some of these brackets are intended to mount to a vertical surface, or to a horizontal surface, but not both, and hence, are not of universal mounting capability. Other brackets consist of multiple pieces. Both drawbacks require manufacture and inventorying of multiple pieces. Other brackets, while avoiding these difficulties, are subject to tight installation tolerances and allow for only relatively small misalignments between the brackets. Still other brackets allow for lateral movement of the headrail within the bracket.

It would be desirable to provide a bracket and headrail combination which can be easily manufactured.

It would be desirable to provide a bracket and headrail combination where the headrail can be easily installed and removed without the need for tools.

It would be desirable to provide a bracket and headrail combination where the bracket is substantially hidden from view, providing a clean and continuous appearance for the headrail.

It would be desirable to provide a bracket and headrail combination where the bracket can be mounted either to a vertical or to a horizontal surface, and where the bracket is in one piece.

It would be desirable to provide a bracket and headrail combination which allows for relatively greater misalignment between the brackets, allowing for greater ease in installation.

It would be desirable to provide a bracket in which a conventional headrail can be easily installed and removed without the need for tools.

It would be desirable to provide a bracket for mounting a conventional headrail where the bracket is substantially hidden from view, providing a clean and continuous appearance for the headrail.

It would be desirable to provide a bracket for mounting a conventional headrail where the bracket can be mounted either to a vertical or to a horizontal surface, and where the bracket is in one piece.

It would be desirable to provide a bracket for mounting a conventional headrail which allows for relatively greater misalignment between the brackets, allowing for greater ease in installation.

BRIEF DESCRIPTION OF THE INVENTION

Accordingly, it is an object of the present invention to provide a bracket and headrail combination which can be easily manufactured.

Another object of the present invention is to provide a bracket and headrail combination where the headrail can be easily installed in and removed from the bracket without the need for tools.

Another object of the present invention is to provide a bracket and headrail combination where the bracket is substantially hidden from view when the headrail is installed, providing a clean and continuous appearance for the headrail.

Another object of the present invention is to provide a bracket and headrail combination where the bracket can be mounted either to a vertical or to a horizontal surface, and where the bracket is in one piece, thereby reducing inventory requirements.

Another object of the present invention is to provide a bracket and headrail combination which allows for relatively greater misalignment between the brackets, thereby easing installation of the brackets and headrail.

Another object of the present invention is to provide a bracket in which a conventional headrail can be easily installed and removed without the need for tools.

Another object of the present invention is to provide a bracket for mounting a conventional headrail where the bracket is substantially hidden from view, providing a clean and continuous appearance for the headrail.

Another object of the present invention is to provide a bracket for mounting a conventional headrail where the bracket can be mounted either to a vertical or to a horizontal surface, and where the bracket is in one piece.

Another object of the present invention is to provide a bracket for mounting a conventional headrail which allows for relatively greater misalignment between the brackets, allowing for greater ease in installation.

These and other objects of this invention are accomplished in a preferred embodiment chosen for the purpose of illustration only in which a headrail has a bottom wall with longitudinally extending front and rear edges, and a front and rear wall extending vertically upward from the front and rear edges. The top edge of the rear wall has a rear headrail lip extending horizontally toward the front wall, and the top edge of the front wall has a front headrail lip extending horizontally toward the rear wall. The front headrail lip is located at a vertical position above the rear headrail lip. Located on the outside surface of the rear wall is a longitudinally extending hook rail.

The bracket comprises a rear plate and a top plate, each plate having means for connection to an adjacent wall surface. The rear plate has a bottom ledge extending horizontally from the bottom edge of the rear plate in the same direction as the top plate. A restraining barb extends vertically upwardly from the bottom ledge.

The top plate has a ramp portion extending downwardly at an angle from the front edge of the top plate. Extending horizontally from the front edge of the ramp portion is a front bracket lip, which supports the front headrail lip from below. Extending downwardly at angle from the front edge of the top plate towards the rear plate are a pair of spring arms ending in restraining lips.

Installation of the headrail is initiated after at least two brackets have been attached to a suitable surface. The front headrail lip is first slipped over the front bracket lips of each bracket. The headrail is then urged upward at an angle into each bracket, causing the restraining lips of the spring arms of each bracket to engage the rear headrail lip. After the hook rail has passed over the restraining barb, release of the headrail allows the spring arms to force the rear headrail lip and rear wall downwardly, forcing the hook rail into locking engagement with the restraining barb. When the headrail is locked in position, the restraining barb supports the rear wall, and the front bracket lip supports the front wall. The restraining barb and hook rail also prevent any movement towards or away from the rear plate by the headrail when the headrail is installed.

Several features of the invention are associated with other functions of the restraining barb. The restraining barb prevents any longitudinal sliding of the headrail while the headrail is locked in the bracket. The restraining barb also allows for greater angular misalignment between mounting brackets than other mounting arrangements since the restraining barb contacts the hook rail at a single point and not along an edge.

In an alternate embodiment the bracket of the invention is used for mounting a conventional headrail and associated blind to a window opening.

In another alternate embodiment the bracket of the invention is used with a headrail of simplified configuration similar to the headrail of the preferred embodiment.

BRIEF DESCRIPTION OF THE DRAWINGS

The above and other objects and advantages of this invention will be apparent upon consideration of the following detailed description, taken in conjunction with the accompanying drawings, in which like reference characters refer to like parts throughout, and in which.

Figure 7:
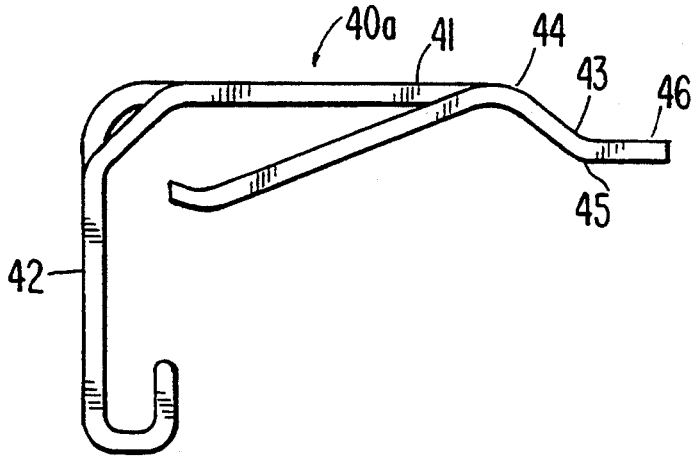
Figure 8:
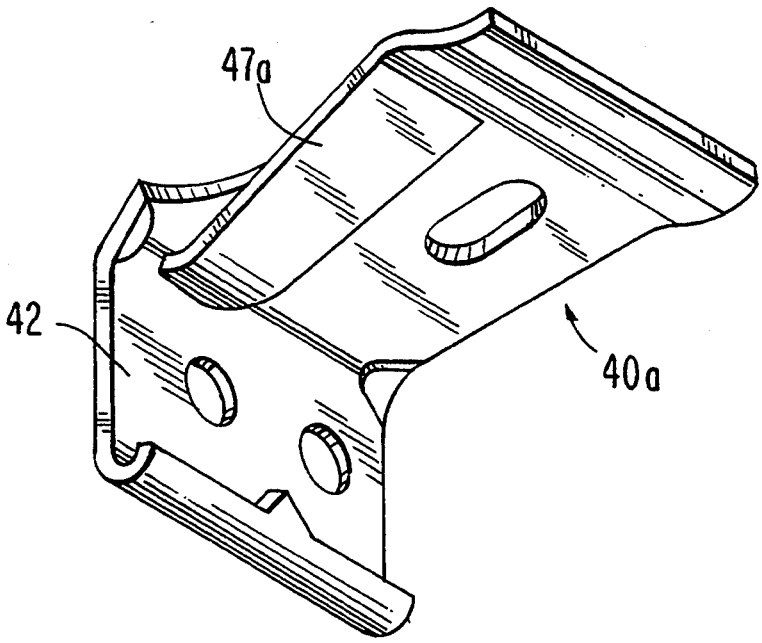
Figure 9:
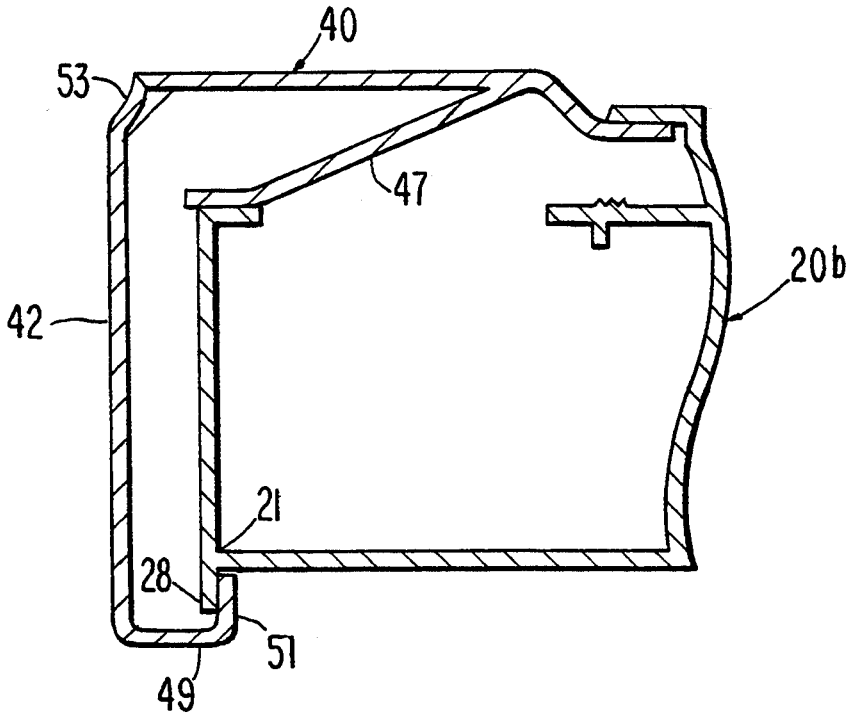
Figure 10:
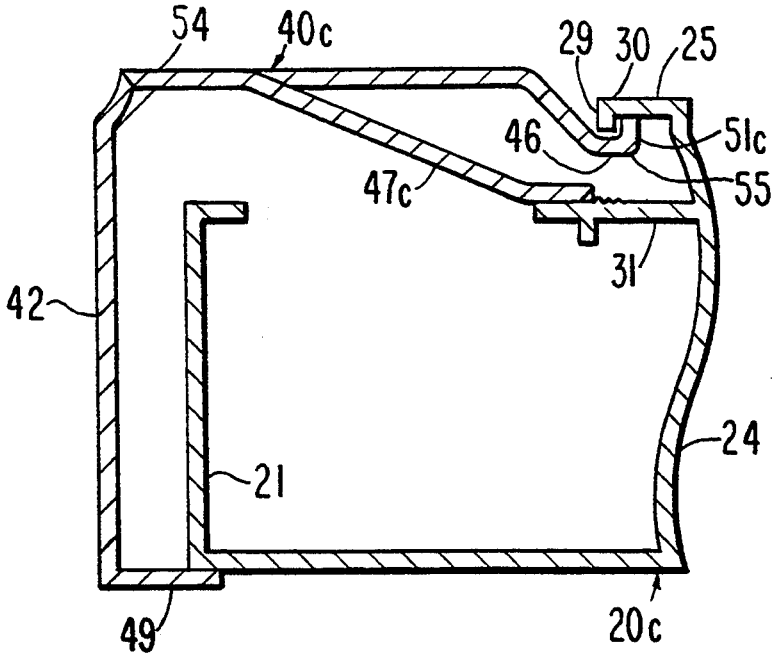
Figure 11:
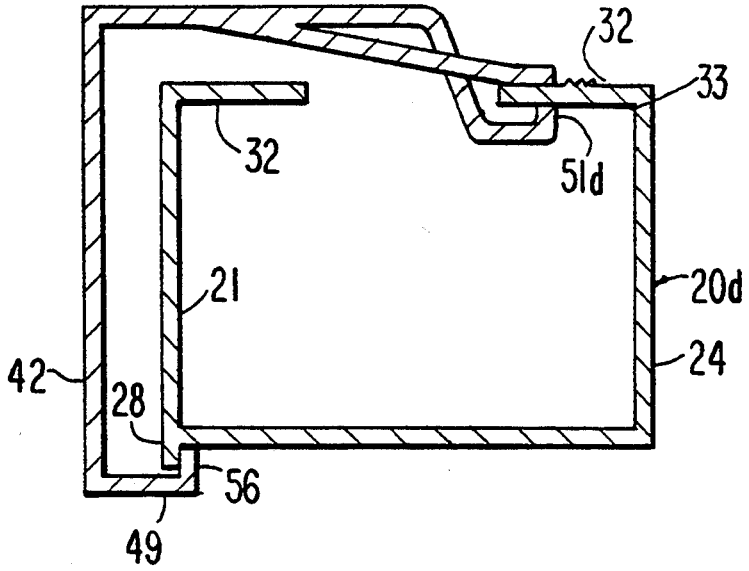
Figure 12:
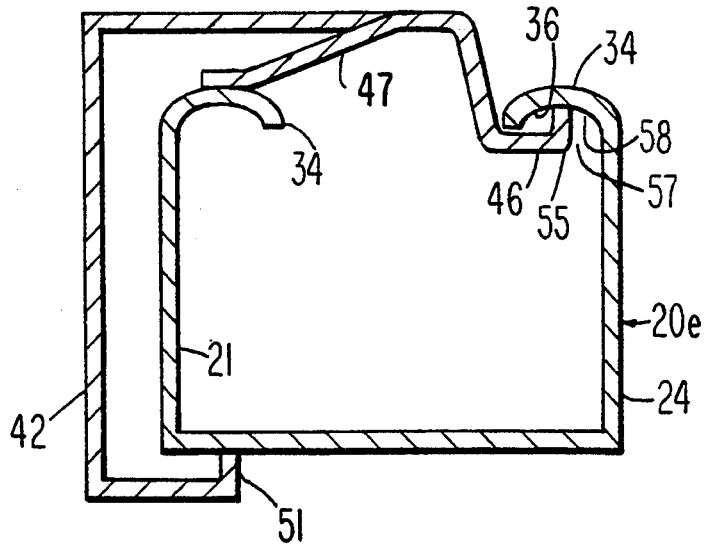

PIG. 6 is a cross-sectional view view of a headrail locked into fixed alignment with a bracket;

FIG. 7 is a view of an alternate embodiment of this invention showing a bracket in end elevation;

FIG. 8 is a view of an alternate embodiment of this invention showing a bracket in perspective;

FIG. 9 is a cross-sectional view of an alternate embodiment of this invention showing a headrail installed in a bracket;

FIG. 10 is a cross-sectional view of an alternate embodiment of this invention showing a headrail installed in a bracket;

FIG. 11 is a cross-sectional view of an alternate embodiment of this invention showing a headrail of simpler configuration mounted in a bracket; and FIG. 12 is a cross-sectional view of an alternate embodiment of this invention showing a headrail of standard profile mounted in a bracket.

DETAILED DESCRIPTION OF THE INVENTION

Figure 1:
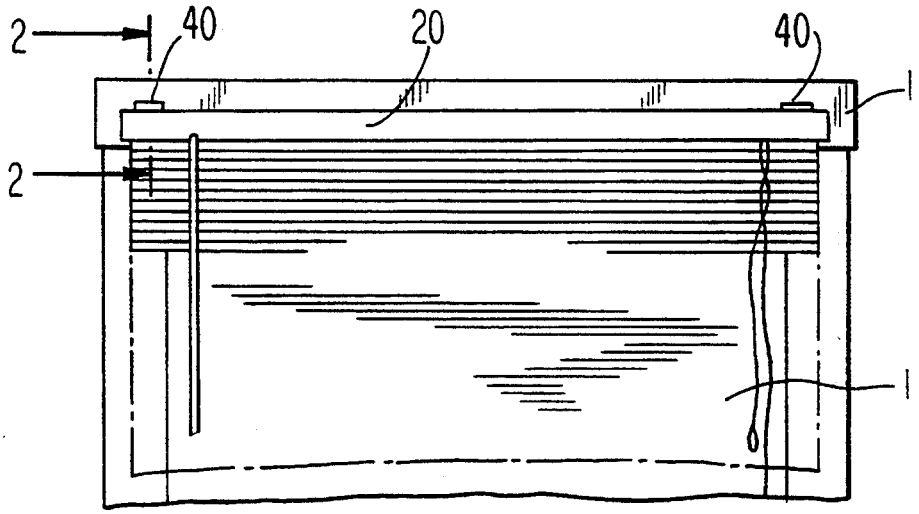
FIG. 1 is a perspective view from the front of a headrail showing a headrail and bracket combination in accordance with this invention supporting a venetian blind in a window opening.

A preferred embodiment of the invention adapted for installation in a window opening is illustrated in FIG. 1. The headrail 20 of a venetian blind has been mounted in a window opening 10 by a pair of brackets 40. The brackets 40 have been mounted to a vertical wall surface 11 adjacent to the window opening 10.

Figure 2:
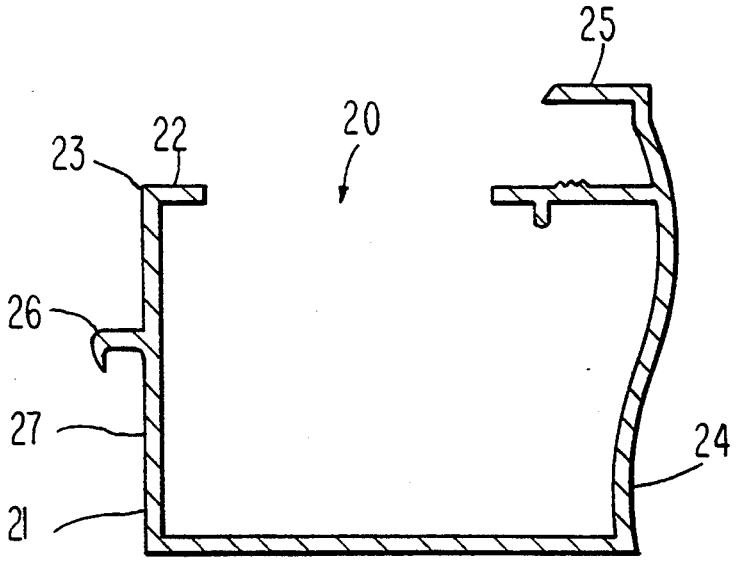
FIG. 2 is a cross-sectional view of the headrail of FIG. 1 taken along line 2—2 of FIG. 1.
Figure 3:
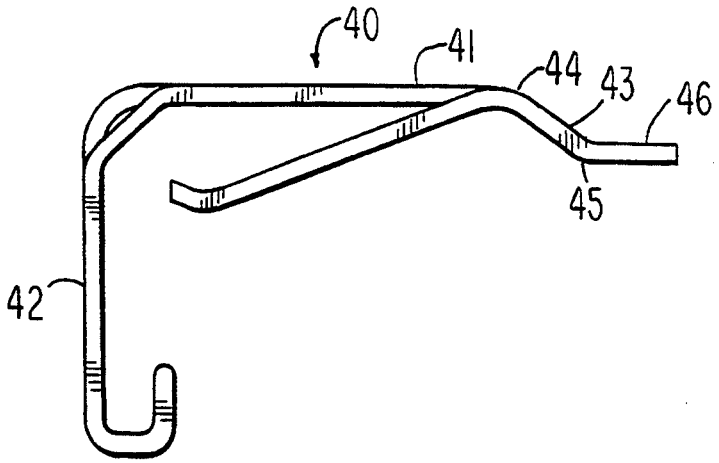
FIG. 3 is an end elevation view of the bracket of FIG. 1 taken along line 2—2 of FIG. 1.
Figure 4:
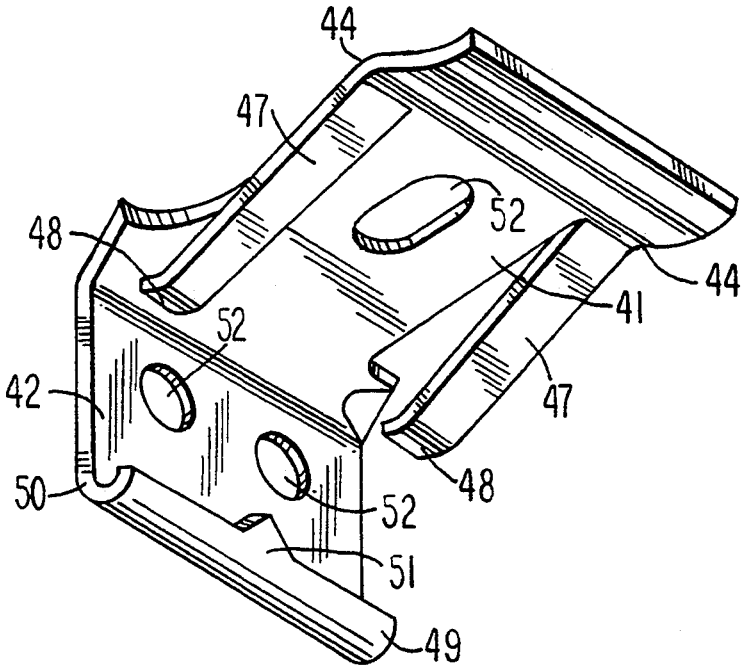
FIG. 4 is a perspective view of a bracket in accordance with this invention.

The features of the individual components of the invention are shown in FIGS. 2–4. FIG. 2 shows the headrail 20 of FIG. 1 in cross section. A rear wall 21 of headrail 20 has a rear headrail lip 22 extending horizontally and inwardly from the top edge 23 of the rear wall 21 towards a front wall 24. The front wall 24 has a front headrail lip 25 extending horizontally and inwardly towards the rear headrail lip 22 of the rear wall 21. The front headrail lip 25 is located at a vertical position above the rear headrail lip 22. The headrail 20 also has a longitudinally extending hook rail 26 located on the outer surface 27 of the rear wall 21.

The bracket 40 of FIG. 1 is shown in end elevation in FIG. 3. One bracket is shown for ease of description, although at least two brackets are required for installation. Each bracket of the preferred embodiment is identical, and the headrail is mounted in each bracket in the same fashion. The bracket may be constructed from any material familiar to those skilled in the art which has both rigid and spring-like characteristics. In the end elevation view of FIG. 3 the bracket 40 has a top plate 41 and a rear plate 42. The top plate 41 has a ramp portion 43 extending downwardly and at an angle away from the front edge 44 of the top plate 41. The ramp portion 43 has a front edge 45, and extending horizontally and outwardly from the front edge 45 of the ramp portion 43 is the front bracket lip 46. As shown in the perspective view of FIG. 4 the top plate 41 also has a pair of spring arms 47 extending downwardly and rearwardly from the front edge 44 of the top plate 41 towards the rear plate 42. Each spring arm 47 terminates in a restraining lip 48. The rear plate 42 has a bottom ledge 49 extending outwardly from the bottom edge 50 of the rear plate 42. Extending upwardly from the bottom ledge 49 of the rear plate 42 is a restraining barb 51. As shown, the restraining barb 51 is triangular in shape and ends in a sharp point. Screw holes 52 are visible in the top plate 41 and rear plate 42 for mounting. Two screw holes 52 in the rear plate 42 are required for mounting to a vertical surface, while a single screw hole 52 in the top plate 41 is required for mounting to a horizontal surface.

Figure 5:
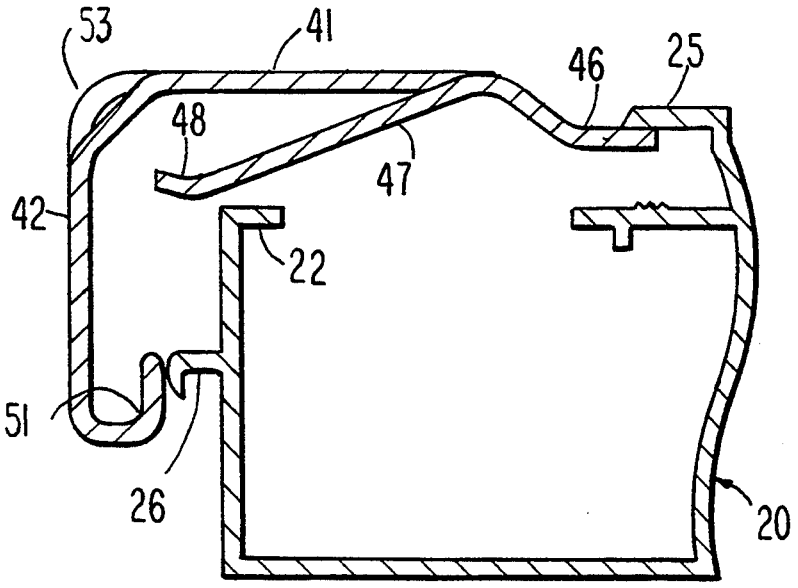
FIG. 5 is a cross-sectional view of a headrail being pivoted into position in a bracket.
Figure 6:
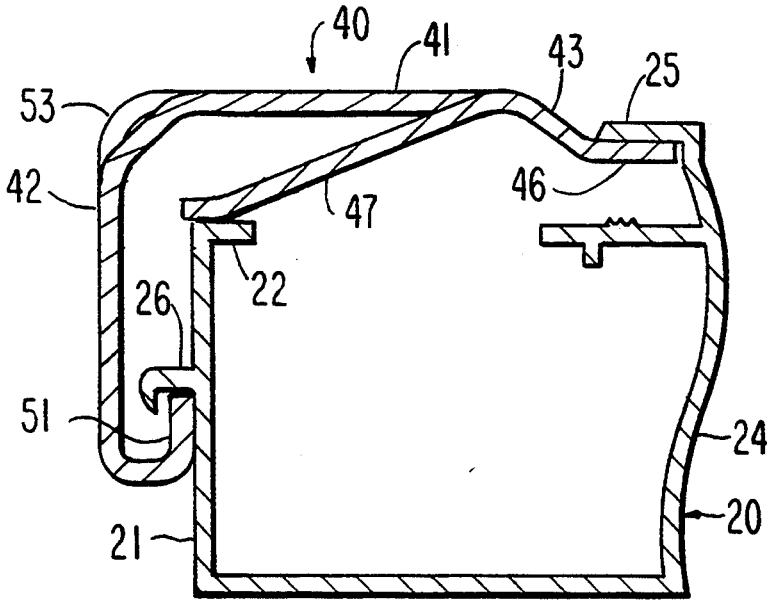

A feature of this invention, ease of installation of the headrail 20, is shown in FIG. 5. After the brackets have been mounted in a window opening, the front headrail lip 25 is slipped over the top of the front bracket lip 46 of each bracket. In FIG. 5 a single bracket is shown for ease of illustration. The headrail 20 is locked into fixed alignment with each bracket by urging the headrail 20 up at an angle toward the corner 53 formed by the intersection of the rear plate 42 and the top plate 41. This forces the rear headrail lip 22 up into contact with the restraining lips 48 of the spring arms 47, and also allows the hook rail 26 to pass over the restraining barb 51. As shown in FIG. 6, upon release of the headrail the recoil of the spring arms 47 forces the rear headrail lip 22 and rear wall 21 downwards, thereby allowing the hook rail 26 to engage the restraining barb 51.

Although the spring arms 47 and restraining barb 51 are shown operating in a vertical plane, in a different bracket configuration the spring arms and restraining barb may operate in a horizontal plane. In this configuration the spring arms and restraining barb would also restrict movement of the headrail 20 toward or away from the rear plate 42 of the bracket 40.

Each step of the headrail installation is accomplished without the need for tools. To remove the headrail 20, the steps are reversed. The headrail 20 is urged upward and at an angle towards the corner 53 in the bracket 40 until the hook rail 26 passes over the restraining barb 51. When the hook rail 26 clears the restraining barb 51, the headrail 20 can be pulled away from the bracket 40.

When installed as shown in FIG. 6, the headrail 20 is restrained from any downward movement by the restraining barb 51, which supports the hook rail 26 and rear wall 21, and by the front bracket lip 46, which supports the front headrail lip 25 and front wall 24. The combined action of the hook rail 26 and the restraining barb 51 prevent any movement by the headrail 20 horizontally either toward or away from the rear plate 42 of the bracket 40. The restraining barb 51 and spring arms 47 also provide another feature of the invention. Since the spring arms 47 cause the restraining barb 51 to grippingly engage the hook rail 26, longitudinal sliding of the headrail 20 in the bracket 40 is prevented.

The single contact point of the restraining barb 51 provides an additional feature of the invention. If all gripping surfaces in brackets are of substantial longitudinal extent, the brackets will allow for little or no misalignment in their installation. In other words, each bracket will have to be mounted at the same vertical height and exactly level in order for the headrail to be successfully installed. Reduction of one gripping edge to a restraining barb 51 as in this invention allows for successful headrail installation with somewhat greater misalignment between brackets. This misalignment may be caused by irregularities in the architectural surface to which the bracket is mounted, and may be unavoidable without substantial alteration of the surface.

Examination of the end elevation view of FIG. 6 also demonstrates another feature of the invention, the reduced visibility of the bracket 40. Assuming a viewing position from the front of the headrail 20, only the ramp portion 43 of the top plate 41 is visible. No portion of the rear plate 42 is apparent.

An alternate embodiment of the invention is depicted in FIG. 7, which shows a different bracket configuration. In the end elevation view of bracket **40*a* the top plate 41 and rear plate 42 are visible. As in the preferred embodiment the top plate 41 has a ramp portion 43 extending downwardly at an angle away from the front edge 44 of the top plate 41. The ramp portion 43 has a front edge 45, and extending horizontally and outwardly from the front edge 45 of the ramp portion 43 is the front bracket lip 46. As shown in the perspective view of FIG. 8, the bracket 40*a* of the alternate embodiment has a single spring arm 47*a* instead of a pair, as in the preferred embodiment. The single spring arm 47*a* of the alternate embodiment extends downwardly and rearwardly towards the rear plate 42. The spring arm 47*a* of the alternate embodiment is adapted to mount the headrail 20** in similar fashion as the preferred embodiment.

Another variation of the preferred embodiment is illustrated in FIG. 9, which shows a bracket and headrail combination with a different hook arrangement. Here the headrail **20*b* has a rear wall lip 28 extending downwardly from the rear wall 21 of headrail 20*b*. The headrail 20*b* is installed by urging the headrail upward and at an angle toward the corner 53 in the bracket 40 until the rear wall lip 28 clears the restraining barb 51, at which point release of the headrail 20*b* allows the spring arms 47 to force the headrail 20*b* into engagement with the bracket 40. The rear plate 42, bottom ledge 49 and restraining barb 51 form a channel into which the rear wall lip 28 extends. If the headrail moves horizontally towards or away from the rear plate 42, this movement will be restricted by the rear plate 42 operating on the rear wall 21 and the restraining barb 51 operating on the rear wall lip 28**.

In still another variation of the preferred embodiment the configuration of the spring arms and restraining barb are altered. FIG. 10 depicts this bracket and headrail combination. In FIG. 10 the spring arms **47*c* of the bracket 40*c* extend downward at an angle from a rear edge 54 of the bracket 40*c* in a direction away from the rear plate 42. The restraining barb has been moved to the front bracket lip 46. The restraining barb 51*c* extends vertically upward from a front edge 55 of the front bracket lip 46. The headrail 20*c* has also been altered by moving the hook rail to the front headrail lip 25. This is accomplished by adding a lip extension 29 extending vertically downward from a front edge 30 of the front headrail lip 25. When the headrail 20*c* is installed the spring arms 47*c* engage the lower headrail lip 31 of the front wall 24. The restraining barb 51*c* and the bottom ledge 49 support the front wall 24 and rear wall 21 of the headrail 20*c* while the spring arms 47*c* force the headrail 20*c* downwards, thus restricting the headrail 20*c* from downward movement. The headrail 20*c* is restricted from horizontal movement toward or away from the rear plate 42 of the bracket 40*c* by the restraining barb 51*c* which extends vertically upward into a channel formed by the lip extension 29, the front bracket lip 25 and the front wall 24. If horizontal movement of the headrail 20*c* occurs, the lip extension 29 or the front wall 24 will impinge on the restraining barb 51*c*, thereby restricting further movement. As in the preferred embodiment, the combined effect of the spring arms 47*c* and the restraining barb 51*c* create friction restricting lateral movement of the headrail 20*c* in the bracket 40*c***.

In an alternate embodiment the bracket of the invention is used with a headrail of somewhat simpler configuration. This headrail and bracket combination is depicted in the cross-sectional view of FIG. 11. The headrail **20*d* has a rectangular box-like profile. The front and rear headrail lips of the preferred embodiment have been replaced by support lips 32 which extend horizontally inwards from the top edges of the rear wall 21 and the front wall 24 of the headrail 20*d*. When installed the restraining barb 51*d* supports the inner surface 33 of the support lip 32 of the front wall 24 and a longitudinally extending rear bracket lip 56 standing vertically upward from the bottom ledge 49 of the rear plate 42 supports the rear wall 21. The rear bracket lip 56, bottom ledge 49 and rear plate 42 form a channel into which the rear wall lip 28 extends. This channel restricts movement of the headrail 20*d* toward or away from the rear plate 42**.

In another alternate embodiment the bracket of this invention can be used to install a headrail of conventional industry-standard profile. This embodiment has the same advantages as the preferred embodiment. As in previous embodiments at least two brackets are required to mount the headrail in a window opening. In FIG. 12 an installed headrail 20*e* of conventional U-shaped profile is depicted in cross section. Here the front and rear headrail lips of the preferred embodiment have been replaced by inwardly rolled upper edges 34 which extend inwardly from the top edges of the front wall 21 and rear wall 24 of the headrail 20*e*. The bracket supports the headrail 20*e* in much the same way as in the preferred embodiment. The front bracket lip 46 and restraining barb 51 restrict the headrail from downward movement caused by the spring arms 47. The headrail 20*e* is restrained from horizontal movement toward or away from the rear plate 42 by a front bracket lip extension 57 standing vertically upward from the front edge 55 of the front bracket lip 46. The front bracket lip extension 57 extends into a channel 58 formed by the inwardly rolled upper edge 34 of the front wall 24. This front bracket lip extension 57 prevents movement of the headrail 20*e* towards or away from the rear plate 42 by restricting movement of the inner surface 36 of the inwardly rolled upper edge 34.

One skilled in the art will appreciate that the present invention can be practiced by other than the described embodiments, which are presented for the purposes of illustration and not of limitation, and the present invention is limited only by the claims that follow.

What is claimed is;

1. A bracket for supporting a headrail and a blind in a window opening, said bracket comprising:

a rear body portion, said rear body portion having longitudinally extending top and bottom edges;

a top body portion extending horizontally from said top edge of said rear body portion;

mounting means associated with at least one of said body portions for mounting said bracket to said window opening;

support means for restricting said headrail from downward movement;

restraining means for restricting movement of said headrail horizontally toward or away from said rear body portion;

a restraining barb associated with said support means for engaging said headrail at a point, said restraining barb being substantially triangular in shape and ending in a point;

spring means for engaging said headrail and for urging said headrail into said restraining barb, said spring means and said restraining barb creating friction restricting said headrail from lateral movement in said bracket.

2. The bracket of claim 1 wherein said spring means comprises a pair of spring arms extending downwardly at an angle from a rear edge of said top body portion in a direction away from said rear body portion, said spring arms disposed oppositely on said top body portion of said bracket, said spring arms ending in restraining lips for engaging said headrail and for urging said headrail downwardly.

3. The bracket of claim 1 wherein said spring means comprises a single spring arm extending downwardly at an angle from a rear edge of said top body portion in a direction away from said rear body portion, said spring arm disposed on a side of said top body portion of said bracket, said spring arm ending in a restraining lip for engaging said headrail and for urging said headrail downwardly.

4. A bracket for supporting a headrail and a blind in a window opening, said bracket comprising:

a rear body portion, said rear body portion having longitudinally extending top and bottom edges;

a top body portion extending horizontally from said top edge of said rear body portion;

mounting means associated with at least one of said body portion for mounting said bracket to said window opening;

rear support means associated with said rear body portion for engaging a first headrail surface adjacent to said rear body portion and for restricting said headrail from downward movement;

front support means associated with said top body portion for engaging a second headrail surface adjacent to said top body portion and for restricting said headrail from downward movement;

restraining means for restricting movement of said headrail horizontally toward or away from said rear body portion;

a restraining barb associated with one of said support means for engaging said headrail at a point, said restraining barb being substantially triangular in shape and ending in a point, said restraining barb extending upwardly from one of said support mean;

spring means for engaging said headrail and for urging said headrail into said restraining barb, said spring means and said restraining barb creating friction restricting said headrail from lateral movement in said bracket.

5. The bracket of claim 4 wherein said rear support means comprises a ledge extending horizontally from said bottom edge of said rear body portion in the same direction as said top body portion, said ledge supporting said headrail.

6. The bracket of claim 4 wherein said rear support means comprises a rear bracket lip extending vertically upward from a bottom ledge of said rear body portion, said bottom ledge extending horizontally from said bottom edge of said rear body portion in the same direction as said top body portion, said rear bracket lip engaging said first headrail surface from below, said rear bracket lip restricting said first headrail surface from downward movement;

said restraining means comprises a channel formed by said rear body portion, said bottom ledge and said rear bracket lip, a lip of said headrail extending downwardly into said channel and said channel restricting said lip and said headrail from movement horizontally toward or away from said rear body portion;

said front support means comprises said restraining barb, said restraining barb supporting said second headrail surface from downward movement.

7. The bracket of claim 4 wherein said front support means comprises said restraining barb, said restraining barb extending vertically upward from a front edge of said top body portion, said restraining barb supporting said second headrail surface from downward movement;

said restraining means comprises said restraining barb, said restraining barb extending vertically upward into a channel formed in said headrail, said restraining barb restricting said channel and said headrail from horizontal movement toward or away from said rear body portion.

8. A bracket and headrail combination for mounting in a window opening and for supporting a blind in said window opening, comprising:

a headrail having a main horizontal wall, said main horizontal wall having longitudinally extending front and rear edges, said headrail having front and rear walls extending vertically from said front and rear edges of said main horizontal wall, said front and rear walls having top and bottom edges, said rear wall having a rear headrail lip extending horizontally toward said front wall, said front wall having a front headrail lip extending horizontally towards said rear wall, said front headrail lip located at a vertical position above said rear headrail lip;

hook means associated with said headrail;

a bracket having a rear plate, said rear plate having longitudinally extending top and bottom edges, said bracket having a top plate extending horizontally from said top edge of said rear plate, said bracket having means associated with at least one of said plates for mounting to said window opening, said top plate having a front bracket lip extending horizontally from a front edge of said top plate;

rear support means associated with said rear plate for supporting said rear wall of said headrail;

front support means associated with said top plate for supporting said front wall of said headrail;

restraining means associated with said bracket for engaging said hook means for restricting movement of said headrail horizontally toward or away from said rear plate;

a restraining barb associated with said rear support means for engaging said headrail at a point, said restraining barb being substantially triangular in shape and ending in a point, said restraining barb extending upwardly from said rear support means;

spring means associated with said top plate for engaging said rear headrail lip and urging said rear wall and said headrail downwards into said restraining barb associated with said rear support means, while said front support means support said front wall of said headrail and said rear support means supports said rear wall, said front support means and said rear support means restricting said headrail from downward motion, said spring means and said restraining barb creating friction restricting headrail from lateral movement in said bracket.

9. A bracket for supporting a headrail and a blind in a window opening, said headrail being substantially U-shaped, said headrail having vertically standing front and rear walls, said front and rear walls having inwardly rolled upper edges, said bracket comprising:

a rear plate, said rear plate having longitudinally extending top and bottom edges;

a top plate extending horizontally from said top edge of said rear plate, said top plate having a ramp portion extending downwardly at an angle from a front edge of said top plate, said top plate having a front bracket lip extending horizontally from a front edge of said ramp portion, said top plate having a rear edge;

mounting means associated with at least one of said plates for mounting said bracket to said window opening;

rear support means associated with said rear plate for supporting said rear wall of said headrail;

front support means associated with said top plate for supporting said front wall of said headrail;

rearward motion restraining means for restricting motion of said headrail horizontally toward said rear plate of said bracket;

forward motion restraining means for restricting motion of said headrail horizontally away from said rear plate of said bracket;

a restraining barb associated with one of said support means for engaging said headrail at a point, said restraining barb being substantially triangular in shape and ending in a point, said restraining barb extending upwardly from one of said support means;

spring means associated with said top plate for urging one of said vertically standing walls and said headrail downward into said restraining barb associated with one of said support means by engaging an outer surface of said inwardly rolled upper edge of said vertically standing wall while said front support means supports said front wall and said rear support means supports said rear wall, said front and rear support means restricting said headrail from downward motion caused by said spring means, said spring means and said restraining barb creating friction restricting headrail from lateral movement in said bracket.

10. A bracket and headrail combination for mounting in a window opening and for supporting a blind in said window opening, comprising:

a headrail having a bottom wall, said bottom wall having longitudinally extending front and rear edges, said headrail having a front and rear wall vertically standing from said front and rear edges of said bottom wall, said front and rear walls having top and bottom edges, said headrail having support lips extending horizontally inwardly from said top edges of said front and rear walls;

hook means associated with said headrail;

a bracket having a rear plate, said rear plate having longitudinally extending top and bottom edges, said bracket having a top plate extending horizontally from said top edge of said rear plate, said bracket having means associated with each of said plates for mounting to said window opening, said top plate having front and rear edges, said top plate having a ramp portion extending downwardly at an angle from said front edges of said top plate, said ramp portion having a front edge, said bracket having a front bracket lip extending horizontally from said front edge of said ramp portion;

rear support means associated with said bracket for supporting said rear wall of said headrail;

front support means associated with said bracket for supporting said front wall of said headrail;

rearward motion restraining means for restricting motion of said headrail horizontally toward said rear plate of said bracket;

forward motion restraining means for restricting motion of said headrail horizontally away from said rear plate of said bracket;

a restraining barb associated with one of said support means for engaging said headrail at a point, said restraining barb substantially triangular in shape and ending in a point, said restraining barb extending upwardly from one of said support means;

spring means associated with said top plate for urging one of said vertically standing walls and said headrail downward into said restraining barb associated with one of said support means by engaging an outer surface of said support lip of said vertically standing wall while said front support means supports said front wall and said rear support means supports said rear wall, said front and rear support means restricting said headrail from downward motion caused by said spring means, said spring means and said restraining barb creating friction restricting headrail from lateral movement in said bracket.

11. A bracket and headrail combination for mounting in a window opening and for supporting a blind in said window opening, comprising:

a headrail having a main horizontal wall, said main horizontal wall having longitudinally extending front and rear edges, said headrail having front and rear walls extending vertically from said front and rear edges of said main horizontal wall, said front and rear walls having top and bottom edges, said headrail having a longitudinally extending bottom wall connecting said bottom edges of said front and rear walls, said rear wall having a rear headrail lip extending horizontally towards said front wall, said front wall having a front headrail lip extending horizontally towards said rear wall, said front headrail lip located at a vertical position above said rear headrail lip;

hook means associated with said headrail, wherein said hook means comprises a rear wall lip extending vertically downward from said bottom edge of said rear wall;

a bracket having a rear plate, said rear plate having longitudinally extending top and bottom edges, said bracket having a top plate extending horizontally from said top edge of said rear plate, said bracket having means associated with at least one of said plates for mounting to said window opening, said top plate having a front bracket lip extending horizontally from a front edge of said top plate;

rear support means associated with said bracket for supporting said rear wall of said headrail, wherein said rear support means comprises a restraining barb extending upwardly from a bottom ledge of said rear plate, said bottom ledge extending horizontally from said bottom edge of said rear plate in the same direction as said top plate, said restraining barb being substantially triangular in shape and ending in a point, said restraining barb engaging said bottom wall of said headrail from below, said restraining barb restricting said bottom wall and said rear wall from downward movement;

front support means associated with said bracket for supporting said front wall of said headrail;

spring means associated with said top plate for engaging said rear headrail lip and urging said rear wall of said headrail downwards while said front support means supports said front wall of said headrail and said restraining barb supports said rear wall, said front support means and said restraining barb restricting said headrail from downward motion;

restraining means associated with said bracket for engaging said hook means for restricting movement of said headrail horizontally toward or away from said rear plate, wherein said restraining means comprises a channel formed by said rear plate, said bottom ledge, and said restraining barb, said rear wall lip extending downwardly into said channel and said channel restricting said rear wall lip and said headrail from movement toward or away from said rear plate;

gripping means associated with said rear plate for engaging said headrail at a point, wherein said gripping means comprises said restraining barb, said restraining barb urged into engagement with said headrail by said spring means, said spring means and said restraining barb creating friction restricting headrail from lateral movement in said bracket.

12. A bracket and headrail combination for mounting in a window opening and for supporting a blind in said window opening, comprising:

a headrail having a main horizontal wall, said main horizontal wall having longitudinally extending front and rear edges, said headrail having front and rear walls extending vertically from said front and rear edges of said main horizontal wall, said front and rear walls having top and bottom edges, said rear wall having a rear headrail lip extending horizontally towards said front wall, said front wall having a front headrail lip extending horizontally towards said rear wall, said front headrail lip located at a vertical position above said rear headrail lip;

hook means associated with said headrail, wherein said hook means comprises a substantially hook-shaped rail extending outwardly from an outer surface of said rear wall of said headrail between said top and bottom edges of said rear wall, said hook-shaped rail longitudinally extending along said rear wall, said hook-shaped rail facing downwards;

a bracket having a rear plate, said rear plate having longitudinally extending top and bottom edges, said bracket having a top plate extending horizontally from said top edge of said rear plate, said bracket having means associated with at least one of said plates for mounting to said window opening, said top plate having front bracket lip extending horizontally from a front edge of said top plate;

rear support means associated with said bracket for supporting said rear wall of said headrail, wherein said rear support means comprises a restraining barb extending upwardly from a bottom ledge of said rear plate, said bottom ledge extending horizontally from said bottom edge of said rear plate in the same direction as said top plate, said restraining barb being substantially triangular in shape and ending in a point, said restraining barb engaging said hook-shaped rail from below, said restraining barb restricting said hook-shaped rail and said rear wall from downward movement;

front support means associated with said bracket for supporting said front wall of said headrail;

spring means associated with said top plate for engaging said rear headrail lip and urging said rear wall of said headrail downwards while said front support means supports said front wall of said headrail and said restraining barb supports said rear wall, said front support means and said restraining barb restricting said headrail from downward motion;

restraining means associated with said bracket for engaging said hook means for restricting movement of said headrail horizontally toward or away from said rear plate, wherein said restraining means comprises said restraining barb, said restraining barb extending vertically upwardly into a channel formed by said hook-shaped rail, said restraining barb restricting said hook-shaped rail and said headrail from horizontal movement toward or away from said rear plate;

gripping means associated with said rear plate for engaging said headrail at a point, wherein said gripping means comprises said restraining barb, said restraining barb urged into engagement with said hook-shaped rail by said spring means, said spring means and said restraining barb creating friction restricting headrail from lateral movement in said bracket.

13. A bracket for supporting a headrail and a blind in a window opening, said headrail being substantially U-shaped, said headrail having vertically standing front and rear walls, said front and rear walls having inwardly rolled upper edges, said bracket comprising:

a rear plate, said rear plate having longitudinally extending top and bottom edges;

a top plate extending horizontally from said top edge of said rear plate, said top plate having a ramp portion extending downwardly at an angle from a front edge of said top plate, said top plate having a front bracket lip extending horizontally from a front edge of said ramp portion, said top plate having a rear edge;

mounting means associated with at least one of said plates for mounting said bracket to said window opening;

rear support means associated with said rear plate for supporting said rear wall of said headrail, wherein said rear support means comprises a restraining barb extending vertically upward from a front edge of a rear plate ledge, said rear plate ledge extending horizontally from said bottom edge of said rear plate in the same direction as said top plate, said restraining barb being substantially triangular in shape and ending in a point, said restraining barb engaging a longitudinally extending bottom wall of said headrail from below;

front support means associated with said top plate for supporting said front wall of said headrail, wherein said front support means comprises said front bracket lip, said front bracket lip supporting said inwardly rolled upper edge of said front wall from below;

spring means associated with said top plate for urging said rear wall of said headrail downward, wherein said spring means comprises a pair of spring arms extending downwardly at an angle from said front edge of said top plate towards said rear plate, said spring arms disposed oppositely on said top plate, said spring arms engaging an outer surface of said inwardly rolled upper edge of said rear wall while said front bracket lip supports said front wall and said restraining barb supports said rear wall, said front bracket lip and restraining barb restricting said headrail from downward motion caused by said spring means;

rearward motion and forward motion restraining means for restricting motion of said headrail horizontally toward or away from said rear plate of said bracket, wherein said rearward motion and forward motion restraining means comprises a front bracket lip extension extending upwardly from a front edge of said front bracket lip into a channel formed by said inwardly rolled upper edge of said front wall, said front bracket lip extension restricting horizontal movement of said headrail toward or away from said rear plate by restricting movement of said channel formed by said inwardly rolled upper edge of said front wall; and gripping means for engaging said headrail at a point, wherein said gripping means comprises said restraining barb, said restraining barb urged into engagement with said inner surface of said inwardly rolled upper edge of said front wall by said spring arms, said spring arms and said restraining barb creating friction restricting headrail from lateral movement in said bracket.

14. A bracket and headrail combination for mounting in a window opening and for supporting a blind in said window opening, comprising:

a headrail having a bottom wall, said bottom wall having longitudinally extending front and rear edges, said headrail having a front and rear wall vertically standing from said front and rear edges of said bottom wall, said front and rear walls having top and bottom edges, said headrail having support lips extending horizontally inwardly from said top edges of said front and rear walls;

hook means associated with said headrail, wherein said hook means comprises a rear wall lip extending vertically downward from said bottom edge of said rear wall;

a bracket having a rear plate, said rear plate having longitudinally extending top and bottom edges, said bracket having a top plate extending horizontally from said top edge of said rear plate, said bracket having means associated with each of said plates for mounting to said window opening, said top plate having front and rear edges, said top plate having a ramp portion extending downwardly at an angle from said front edge of said top plate, said ramp portion having a front edge, said bracket having a front bracket lip extending horizontally from said front edge of said ramp portion;

rear support means associated with said bracket for supporting said rear wall of said headrail, wherein said rear support means comprises a restraining barb extending vertically upward from a front edge of said rear plate ledge, said rear plate ledge extending horizontally from said bottom edge of a rear plate ledge in the same direction as said top plate, said restraining barb being substantially triangular in shape and ending in a point, said restraining barb engaging said bottom wall of said headrail from below;

front support means associated with said bracket for supporting said front wall of said headrail, wherein said front support means comprises said front bracket lip, said front bracket lip supporting said support lip of said front wall from below;

spring means associated with said top plate for urging said rear wall of said headrail downward, wherein said spring means comprises a pair of spring arms extending downwardly at an angle from said front edge of said top plate towards said rear plate, said spring arms disposed oppositely on said top plate, said spring arms engaging an outer surface of said support lip of said rear wall while said front bracket lip supports said front wall and said restraining barb supports said rear wall, said front bracket lip and said restraining barb restricting said headrail from downward motion caused by said spring means;

rearward motion and forward motion restraining means for restricting motion of said headrail horizontally toward or away from said rear plate of said bracket, wherein said rearward motion and forward motion restraining means comprises a channel formed by said rear plate, said bottom ledge and said restraining barb, said rear wall lip extending downwardly into said channel and said channel restricting said rear wall lip and said headrail from horizontally movement toward or away from said rear plate;

gripping means for engaging said headrail at a point, wherein said gripping means comprises said restraining barb, said restraining barb urged into engagement with said bottom wall of said headrail by said spring arms, said spring arms and said restraining barb creating friction restricting headrail from lateral movement in said bracket.

* * * * *